US010612294B2

(12) United States Patent
Brown et al.

(10) Patent No.: US 10,612,294 B2
(45) Date of Patent: Apr. 7, 2020

(54) SECURITY SCREEN ASSEMBLY

(71) Applicant: Decoview Pty Ltd, Molendinar (AU)

(72) Inventors: Jason Brown, Molendinar (AU); Jay Bond, Molendinar (AU)

(73) Assignee: Decoview Pty Ltd, Molendinar, Queensland (AU)

( * ) Notice: Subject to any disclaimer, the term of this patent is extended or adjusted under 35 U.S.C. 154(b) by 0 days.

(21) Appl. No.: 16/278,376

(22) Filed: Feb. 18, 2019

(65) Prior Publication Data

US 2019/0218850 A1 Jul. 18, 2019

Related U.S. Application Data

(63) Continuation-in-part of application No. PCT/AU2017/050875, filed on Aug. 17, 2017.

(30) Foreign Application Priority Data

Aug. 19, 2016 (AU) ..... 2016903305

(51) Int. Cl.
*E06B 9/52* (2006.01)
*E06B 3/30* (2006.01)
(Continued)

(52) U.S. Cl.
CPC ..... *E06B 3/30* (2013.01); *E06B 3/06* (2013.01); *E06B 3/72* (2013.01); *E06B 5/11* (2013.01);
(Continued)

(58) Field of Classification Search
CPC ..... E06B 3/549; E06B 3/585; E06B 3/5857; E06B 3/5864; E06B 3/5878; E06B 3/60;
(Continued)

(56) References Cited

U.S. PATENT DOCUMENTS 2,335,361 A * 11/1943 Schiller ..... E06B 9/52 160/395
2,784,781 A * 3/1957 Rhoades ..... E06B 9/52 160/371
(Continued)

FOREIGN PATENT DOCUMENTS

AU 2003244563 3/2004
AU 2006100242 4/2006
(Continued)

OTHER PUBLICATIONS

International Search Report and Written Opinion for PCT/AU2017/050875 dated Nov. 1, 2017.
(Continued)

*Primary Examiner* — Johnnie A. Shablack
(74) *Attorney, Agent, or Firm* — Christopher M. Scherer; DeWitt LLP

(57) ABSTRACT

A security frame is disclosed that is adapted to be fitted to door and window openings and adjustably accommodate decorative panels of differing thicknesses. The frame includes: at least two frame members connectable together to form the frame for accommodating at least one decorative panel; at least one panel clamping bed extending along an inner sidewall of each frame member and having a clamping portion and a channel; and at least one clamping clip including at least one clamping arm configured to clamp a peripheral edge of the at least one decorative panel against the clamping portion. The at least one clamping clip and the channel connect via key arrangements configured to intermesh at a plurality of positions thereby enabling decorative panels of differing thicknesses to be accommodated and clamped to the frame.

16 Claims, 6 Drawing Sheets

(51) Int. Cl.

| | |
|---|---|
| ***E06B 9/24*** | (2006.01) |
| ***E06B 5/11*** | (2006.01) |
| ***E06B 3/06*** | (2006.01) |
| ***E06B 3/72*** | (2006.01) |
| *E06B 3/76* | (2006.01) |
| *E06B 3/12* | (2006.01) |
| *E06B 3/54* | (2006.01) |
| *E06B 3/58* | (2006.01) |
| *E06B 3/70* | (2006.01) |

(52) U.S. Cl.
CPC ..... *E06B 9/24* (2013.01); *E06B 9/52* (2013.01); *E06B 3/12* (2013.01); *E06B 3/549* (2013.01); *E06B 3/585* (2013.01); *E06B 3/76* (2013.01); *E06B 2003/7049* (2013.01); *E06B 2003/7074* (2013.01); *E06B 2009/527* (2013.01)

(58) Field of Classification Search
CPC ..... E06B 3/62; E06B 3/06; E06B 3/16; E06B 3/30; E06B 3/301; E06B 2003/6252; E06B 2003/6255; E06B 7/10; E06B 2009/527; E06B 9/52; E04F 21/00; E04F 21/0023
USPC ..... 160/382, 383, 391, 392, 395, 371, 380; 52/217
See application file for complete search history.

(56) References Cited

U.S. PATENT DOCUMENTS 2,784,782 A * 3/1957 Young ..... E06B 9/52 160/395
2,897,889 A * 8/1959 Kessler ..... B07B 1/48 160/392
3,363,390 A * 1/1968 Crane ..... E06B 3/22 52/716.8
3,766,698 A * 10/1973 Dallen ..... E04B 2/96 52/204.597
3,939,620 A * 2/1976 Bero ..... E05D 1/02 52/717.05
4,127,156 A * 11/1978 Brandt ..... E06B 9/01 160/179
4,132,390 A * 1/1979 Pfarr, Jr. ..... E04H 17/066 160/392
4,232,310 A * 11/1980 Wilson ..... B07B 1/4627 160/10
4,248,018 A * 2/1981 Casamayor ..... E06B 3/28 160/380
4,333,284 A * 6/1982 Meadows ..... E06B 3/7001 160/179
4,544,012 A * 10/1985 Woodward ..... E06B 3/28 160/90
4,787,184 A * 11/1988 Boidron ..... E06B 1/30 52/208
5,007,188 A * 4/1991 Feist ..... B44C 5/02 160/371
5,155,963 A * 10/1992 Woodman ..... A47G 5/00 160/351
5,301,737 A * 4/1994 Martin ..... E06B 9/52 160/380
5,551,205 A * 9/1996 Kidder ..... E04H 17/163 52/716.8
5,894,706 A * 4/1999 Herbst ..... E06B 3/22 160/369
6,032,433 A * 3/2000 Hatziathanasiou ..... B63B 17/02 135/117
6,089,301 A * 7/2000 Smith ..... E06B 9/04 160/368.1
6,151,849 A * 11/2000 Twigg ..... E06B 3/5892 52/204.53
6,279,280 B1 8/2001 Plager
6,298,555 B1 * 10/2001 Vincenti ..... E04F 19/061 138/DIG. 4
6,318,037 B1 * 11/2001 Hansen ..... E06B 1/30 52/204.54
6,467,226 B2 * 10/2002 Dodson ..... E06B 1/30 52/204.1
6,892,787 B1 * 5/2005 Stretch ..... E06B 9/52 160/371
7,021,006 B2 * 4/2006 Farrar ..... B60J 1/2094 49/375
7,257,927 B2 * 8/2007 Sayer ..... B01L 1/50 312/1
7,302,986 B2 * 12/2007 Flack, II ..... E06B 9/24 160/179
7,331,142 B2 * 2/2008 Gerard ..... E06B 3/5892 49/380
7,537,043 B2 * 5/2009 Veivers ..... F16B 5/0028 160/371
8,297,007 B2 * 10/2012 Sayer ..... B01L 1/50 312/1
8,347,939 B2 * 1/2013 Brabeck ..... E06B 9/52 160/371
8,769,909 B2 * 7/2014 McNamee ..... E04F 11/1851 403/329
8,793,932 B1 * 8/2014 Lindgren ..... E06B 7/30 49/501
9,850,701 B1 * 12/2017 Arway ..... E06B 3/5892
2006/0231221 A1 * 10/2006 Chen ..... E06B 9/24 160/392
2008/0006375 A1 * 1/2008 Meadows ..... E06B 9/52 160/371
2009/0071087 A1 * 3/2009 Achen ..... E06B 7/02 52/302.1
2014/0130993 A1 * 5/2014 Zwar ..... E06B 5/00 160/371
2015/0233177 A1 * 8/2015 Marchand ..... E06B 3/285 160/378
2015/0288320 A1 * 10/2015 Stearns ..... H02S 20/23 52/173.3
2019/0218850 A1 * 7/2019 Brown ..... E06B 3/06

FOREIGN PATENT DOCUMENTS

| | | | |
|---|---|---|---|
| AU | 2014202453 | 11/2015 | |
| GB | 2030627 A * | 4/1980 | ..... E06B 3/5857 |
| WO | 1997013950 | 4/1997 | |
| WO | 2000073614 | 12/2000 | |
| WO | 2005095741 | 10/2005 | |

OTHER PUBLICATIONS

International Preliminary Report on Patentability for PCT/AU2017/050875 dated Jan. 2, 2019.

* cited by examiner

SECURITY SCREEN ASSEMBLY

CROSS-REFERENCE TO RELATED APPLICATIONS

This application is a continuation in part of International Application No. PCT/AU2017/050875, filed Aug. 17, 2017, and claiming priority to Australian Application No. 2016903305, filed Aug. 19, 2016, the contents of which are incorporated herein by reference in their entirety.

TECHNICAL FIELD

The present invention relates to a security frame assembly adapted to be fitted to door and window openings. In particular, the present invention concerns a security frame assembly configured to adjustably accommodate at least one decorative panel.

BACKGROUND

Security screens generally include a frame consisting of a plurality of frame members and a sheet of stainless steel mesh secured to adjacent frame members by a plurality of clamping members. The clamping members are usually fastened to the frame members via mechanical fasteners spaced along a length of the frame members. In such instances, the fasteners are typically hidden from view by a plastic cover strip mounted on an inner side of the frame members.

Security screens of the type described above are time consuming to manufacture and present many deficiencies, including but not limited to:

- accessible fasteners that may be compromised from a security perspective to dislodge the mesh;
- weak spots between adjacent fasteners that may be exploited again from a security perspective to bypass the mesh;
- a loss of effectiveness as an insect barrier in exchange for meeting higher security ratings; and/or
- corrosion and/or galvanic corrosion between fasteners, mesh and/or frame member components of the screen.

Recently, it has become desirable to fit a panel to such security screens for enhanced security and/or for decorative purposes. With regard to the latter, such decorative panels may be profiled to include a plurality of perforated openings to create a pattern, motif, decorative shape and/or word(s) on the panel, for example.

Generally, the panels are provided in a range of thicknesses in part according to security demands and in part to minimise panel distortion caused by the profiling of a desired pattern, motif, decorative shape and/or word(s). For example, it is common for a decorative panel of inadequate thickness to become distorted or warped due to heat and/or friction generated during the profiling process.

A problem in general with the type of security screens described above is that they are incapable of adjustably accommodating panels of a range of thicknesses without the need for welding and/or custom manufacturing. Typically, such screens are only capable of accommodating a panel of a single, uniform thickness. Panels of greater thicknesses have to be secured to such security screens by welding or by custom box extrusions fastened to the screen, for example. However, such custom solutions present further problems in that they often render screens incompatible with industry standard security fittings and components.

It will be clearly understood that, if a prior art publication is referred to herein, this reference does not constitute an admission that the publication forms part of the common general knowledge in the art in Australia or in any other country.

SUMMARY OF INVENTION

Embodiments of the present invention provide a security frame assembly and parts thereof, and a method of assembly, which may minimise or overcome at least one of the abovementioned deficiencies or provide a consumer with a useful or commercial choice.

According to a first aspect of the present invention, there is provided a security frame assembly for accommodating at least one decorative panel, said assembly including:

at least two frame members connectable together to form a frame for accommodating the panel, each of the frame members including a pair of opposed ends, an outer wall, an opposed inner wall and a pair of opposed side walls, including an inner sidewall and an opposed outer sidewall;

at least one panel clamping bed extending inwards from and at least partially along a length of the inner sidewall of each frame member and having a clamping portion and a channel, said channel being defined between the inner sidewall and the clamping portion; and at least one clamping clip including a retention portion and at least one clamping arm extending from the retention portion and configured to clamp a peripheral edge portion of the panel against the clamping portion when the retention portion is at least partially received in the channel, wherein said channel and said retention portion each include at least one key arrangement configured to intermesh with each other at a plurality of positions when the retention portion is at least partially received in the channel thereby enabling panels of differing thicknesses to be accommodated and clamped to the security frame.

According to a second aspect of the present invention, there is provided a security frame assembly including:

at least one decorative panel;

at least two frame members connectable together to form a frame for accommodating the at least one decorative panel, each of the frame members including a pair of opposed ends, an outer wall, an opposed inner wall and a pair of opposed side walls, including an inner sidewall and an opposed outer sidewall;

at least one panel clamping bed extending inwards from and at least partially along a length of the inner sidewall of each frame member and having a clamping portion and a channel, said channel being defined between the inner sidewall and the clamping portion; and at least one clamping clip including a retention portion and at least one clamping arm extending from the retention portion and configured to clamp a peripheral edge portion of the at least one decorative panel against the clamping portion when the retention portion is at least partially received in the channel, wherein said channel and said retention portion each include at least one key arrangement configured to intermesh with each other at a plurality of positions when the retention portion is at least partially received in the channel thereby enabling panels of differing thicknesses to be accommodated and clamped to the security frame.

According to a third aspect of the present invention, there is provided a security frame for accommodating at least one decorative panel, including:

at least two frame members connectable together to form the frame for accommodating the at least one decorative panel, each of the frame members including a pair of opposed ends, an outer wall, an opposed inner wall and a pair of opposed side walls, including an inner sidewall and an opposed outer sidewall;

at least one panel clamping bed extending inwards from and at least partially along a length of the inner sidewall of each frame member and having a clamping portion and a channel, said channel being defined between the inner sidewall and the clamping portion; and at least one clamping clip including a retention portion and at least one clamping arm extending from the retention portion and configured to clamp a peripheral edge portion of the at least one decorative panel against the clamping portion when the retention portion is at least partially received in the channel, wherein said channel and said retention portion each include at least one key arrangement configured to intermesh with each other at a plurality of positions when the retention portion is at least partially received in the channel thereby enabling panels of differing thicknesses to be accommodated and clamped to the security frame.

According to a fourth aspect of the present invention, there is provided a frame member connectable to at least one further like frame member for forming a security frame for accommodating at least one decorative panel, said frame member including:

a pair of opposed ends;

an outer wall, an opposed inner wall, and a pair of opposed sidewalls, including an inner sidewall and an opposed outer sidewall; and at least one panel clamping bed extending from and at least partially along a length of the inner sidewall and having a clamping portion and a channel, said channel being defined between the inner sidewall and the clamping portion, wherein said at least one panel clamping bed is configured to engage with at least one clamping clip having a retention portion and at least one clamping arm extending from the retention portion such that said clamping arm clamps a peripheral edge portion of the at least one decorative panel against the clamping portion when the retention portion is at least partially received in the channel, and wherein said channel and said retention portion each include at least one key arrangement configured to intermesh with each other at a plurality of positions when the retention portion is at least partially received in the channel thereby enabling panels of differing thicknesses to be accommodated and clamped to the security frame.

According to a fifth aspect of the present invention, there is provided at least one clamping clip capable of engaging with at least one panel clamping bed associated with a frame member for clamping at least one decorative panel to a security frame formed from the frame member connected to at least one like frame member, said clamping clip including:

a retention portion configured to be at least partially received in a channel of the at least one panel clamping bed; and at least one clamping arm extending from the retention portion and configured to clamp a peripheral edge portion of the at least one decorative panel against a clamping portion of the at least one panel clamping bed when the retention portion is at least partially received in the channel, wherein said retention portion and said channel each include at least one key arrangement configured to intermesh with each other at a plurality of positions when the retention portion is at least partially received in the channel thereby enabling panels of differing thicknesses to be accommodated and clamped to the security frame.

Preferably, wherein the clamping clip when engaged with a frame member may be adjustable to accommodate decorative panels of differing thicknesses.

According to a sixth aspect of the present invention, there is provided a clamping arrangement for clamping at least one decorative panel to a security frame formed from two or more frame members, said arrangement including:

at least one panel clamping bed extending from and at least partially along a length of an inner sidewall of each frame member, said at least one panel clamping bed having a clamping portion and a channel, said channel being defined between the inner sidewall of the frame member and the clamping portion; and at least one clamping clip including a retention portion and at least one clamping arm extending from the retention portion, said clamping arm configured to clamp a peripheral edge portion of the at least one decorative panel against the clamping portion when the retention portion is at least partially received in the channel, wherein said channel and said retention portion each include at least one key arrangement configured to intermesh with each other at a plurality of positions when the retention portion is at least partially received in the channel thereby enabling decorative panels of differing thicknesses to be accommodated and clamped to the security frame.

Advantageously, the present invention provides a security frame assembly configured to adjustably accommodate decorative panels of differing thicknesses while still being compatible with industry standard fittings and components, such as, e.g., corner stakes, handles, screen mesh, locks and hinges. A decorative panel generally irrespective of its thickness can be fitted to the frame assembly and clamped in place by simply aligning and pressing the clamping clip into each frame member until the respective key arrangements intermesh and the decorative panel is firmly clamped in place. The respective key arrangements intermesh with each other at a plurality of positions thereby enabling decorative panels of differing thicknesses to be clamped in place.

Further, the unique clamping arrangement minimises if not obviates conventional weaknesses in contemporary security screens, such as, e.g., accessible fasteners and spaces between adjacent fasteners that can be exploited. Rather, embodiments of the assembly of the present invention advantageously utilises clamping clips that extend an entire length of each frame member and permanently connect to each frame member to clamp a decorative panel in place thereby obviating the need for any additional fasteners.

Moreover, the assembly is compatible with industry standard screen mesh. Accordingly, embodiments of the assembly provide high security ratings, if not the highest, while still providing an effective barrier to small insects, such as, e.g., midges, mosquitoes and flies.

Lastly, most if not all of the components of the assembly are formed from aluminium or inert materials thereby minimising if not obviating corrosion and galvanic corrosion.

As indicated above, the frame assembly has particular, but not exclusive, application as a security window or door for buildings, including domestic residences. However, a person skilled in the art will appreciate that the frame assembly may be used in other applications, such as, e.g., as security frames in motor vehicles, as insect barrier doors and windows, drain and/or vent coverings, wall petitions, patio screens or for public structures, including bus shelters and public telephone boxes.

As indicated above, the frame of the present invention is for accommodating at least one decorative panel. The at least one panel may be of any suitable size, shape and construction and may be formed from any suitable material or materials.

Generally, the at least one panel may have a polygonal shape suitable for filling a central void of the security frame and together with the frame filling a window or door opening. Typically, the panel may have a substantially rectangular shape.

The panel may have two opposed surfaces extending substantially parallel to one another and interconnected by opposing edges, including a top edge, an opposed bottom edge and opposed side edges.

Generally, the panel may include one or more openings extending through the opposed surfaces, preferably perforated and/or profile cut openings. The openings may typically be arranged on the panel to create a decorative pattern, motif, shape or word(s). The openings may be formed in the panel through one or more of laser cutting, router cutting, water jet cutting, jig saw cutting, plasma cutting, punching and any other process capable of forming a defined opening in the panel.

The panel may be formed from metal, plastic, glass, fibre, concrete, stone and/or wood material or materials, preferably metal and/or plastic material or materials, more preferably metal material or materials, such as, e.g., aluminium, titanium or a composite thereof.

The panel may be of any suitable thickness capable of bearing the decorative pattern, motif, shape or word(s). For example, the panel may have a thickness of about 0.2 mm, about 0.4 mm, about 0.6 mm, about 0.8 mm, about 1.0 mm, about 1.2 mm, about 1.4 mm, about 1.6 mm, about 1.8 mm, about 2.0 mm, about 2.2 mm, about 2.4 mm, about 2.6 mm, about 2.8 mm, about 3.0 mm, about 3.2 mm, about 3.4 mm, about 3.6 mm, about 3.8 mm, about 4.0 mm, about 4.2 mm, about 4.4 mm, about 4.6 mm, about 4.8 mm, about 5.0 mm, about 5.2 mm, about 5.4 mm, about 5.6 mm, about 5.8 mm, about 6.0 mm, about 6.2 mm, about 6.4 mm, about 6.6 mm, about 6.8 mm, about 7.0 mm, about 7.2 mm, about 7.4 mm, about 7.6 mm, about 7.8 mm, about 8.0 mm, about 8.2 mm, about 8.4 mm, about 8.6 mm, about 8.8 mm, about 9.0 mm, about 9.2 mm, about 9.4 mm, about 9.6 mm, about 9.8 mm, or even about 10.0 mm between the opposed surface of the panel.

In some embodiments, the frame may accommodate a single decorative panel. In other embodiments, however, the frame may accommodate more than one decorative panel, typically in a side-by-side arrangement however a stacked arrangement is also envisaged.

For example, in some embodiments, the frame may accommodate at least two decorative panels, at least three decorative panels, at least four decorative panels or even at least five decorative panels. In such embodiments, the more than one decorative panel may include panels formed from different materials to achieve a desired aesthetic effect, such as, e.g., aluminium and glass panels, aluminium and plastic panels, or even different types of metal.

The at least two frame members forming the security frame may each be of any suitable size, shape and construction and formed from any suitable material or materials to connect together and form the frame for filling a window or door opening and accommodating the panel. Typically, the frame may include a central void for receiving the panel.

Each frame member may typically have an elongate shape extending longitudinally between the opposed ends, preferably in a linear direction. Although, it is envisaged that a frame member may include one or more bends.

Each frame member may preferably have opposed open ends. Each open end may be in fluid communication with the other through an opening or passage extending entirely through the frame member.

Each frame member may be formed from metal and/or plastic material or materials, typically metal material or materials, such as, e.g., corrosion resistant metal. Preferably, each frame member may be formed from aluminium, titanium or a composite thereof.

Each frame member may be constructed in any suitable way. For example, each frame member may be machine folded from sheet metal or may be an extrusion, preferably the latter.

Each frame member may have a substantially rectangular shape providing four walls, including the outer wall configured to form an outer face of the frame facing outwards from a door or window opening, an opposed inner wall configured to form an inner face of the frame for facing inwards from the door or window opening, and opposed sidewalls, including an inner sidewall and an opposed outer sidewall.

The at least two frame members may be joined or connected together in any suitable way to form the frame, preferably end-to-end. The frame members may be joined or connected directly or indirectly.

Likewise, the frame members may be joined or connected together end-to-end at any suitable angle relative to one another to form the frame to any desired shape, preferably rectangular and of substantially the same shape as the panel. Generally, frame members may be joined or connected end-to-end at right angles/90°. Typically, each join or connection may include at least two frame members.

Any type of join or connection may be used between adjacent frame members. If the frame members are directly joined or connected end-to-end, the join may be a butt joint, a mitre joint, a lap joint, a box joint, a dovetail joint, a daddo joint, or a mortice and tenon joint, typically a butt or mitre joint.

In some embodiments, each frame member may include a first end having a female formation and a second end having a male formation. The frame members may be joined end to end having the male formation at a first end of a first frame member engage or couple with the female formation at a second end of a second frame member.

In other embodiments, the frame members may be joined together end-to-end via a joining component adapted to be operatively associated with or near the respective ends of the frame members to be joined. Each join may include one or more joining components.

The joining component may be operatively associated with the respective ends of the frame members in any suitable way. For example, in some embodiments, the joining component may be fastened to each of the frame members by one or more mechanical or chemical fasteners. In other embodiments, the joining component may be at least partially received in an opening defined in the respective ends of the frame members to be joined.

The joining component may be of any suitable size, shape and construction and formed from any suitable material or materials. The joining component may be a corner connector, a biscuit joiner, a plate joiner or a domino joiner, preferably a corner connector. The joining component may typically be formed from a resilient and durable material or materials, such as, e.g., plastic, fibre-reinforced plastic or metal material or materials. Typically, the joining component may be formed from aluminium or an inert material, such as, e.g., glass-reinforced plastic or fibreglass, preferably the latter.

In some embodiments, the joining component may be configured to be used with frame members having "profiled" ends such that the ends may mate and be connected or joined directly to each other via the joining component such that the two ends meet flush. In such embodiments, the joining component may be substantially L-shaped and include a portion configured to be at least partially received with an open end of each frame member to be joined.

In other embodiments, the joining component may be in the form of a corner connector configured to connect frame members having square-cut ends.

As indicated above, the assembly includes at least one panel clamping bed extending inwards from and at least partially along a length of each frame member. The clamping bed may be of any suitable size, shape and construction for clamping the panel to the frame together with the clamping clip.

Generally, when the frame is formed, a panel clamping bed may extend at least partially along each inner side of the frame.

The panel clamping bed may be of separate construction to each frame member or may be integrally formed with each frame member, preferably the latter.

In broad embodiments, the panel clamping bed may be a structure extending inwards of and at least partially along a length of each frame member for providing the channel and the clamping portion, said channel and said clamping portion both cooperating with the clamping clip for clamping the panel to the frame member.

In some embodiments, the panel clamping bed may have a substantially rectangular profile shape, including an outer wall, an opposed inner wall corresponding to the clamping portion, an inner sidewall, and an opposed outer channel-forming sidewall. The panel clamping bed may be connected or joined to the frame member by a portion of the outer wall extending inwards and past the inner sidewall of the frame member, said portion coinciding as the outer wall of the clamping bed.

In other embodiments, the panel clamping bed may be formed by at least one portion of the outer wall of the frame member extending inwards and past the inner sidewall before folding back on itself to define the clamping portion of the clamping bed and the channel located between the inner sidewall and the clamping portion.

In preferred such embodiments, the panel clamping bed may be formed by at least three portions of the outer wall of the frame member extending inwards and past the inner sidewall. Specifically, the bed may include: a first portion extending inwards in a direction away from the inner sidewall and at least partially towards the inner wall of the frame member; a second portion extending from an end of the first portion at least partially towards the inner sidewall; and a third portion orthogonally extending from an end of the second portion to the first portion to define the channel between the inner sidewall and the third portion.

The end of the first portion may preferably curve towards the inner wall. The curve may be defined by a constant or uniformly changing radius or some other suitable curve.

The first portion may preferably extend in a curvilinear direction. The second and third portions may preferably each extend in a linear direction.

The second portion may preferably correspond to the clamping portion of the clamping bed. The clamping portion may be substantially planar.

The channel may preferably be defined by a pair of opposed sidewalls corresponding to at least a part of the inner sidewall of the frame member and at least a part of the third portion of the panel clamping bed, and a bottom wall corresponding to at least a part of the first portion of the panel clamping bed. The channel may preferably be sized and shaped to snugly receive and frictionally engage the retention portion of the clamping clip.

In some embodiments, each frame member may include two or more panel clamping beds extending at least partially along and inwards from the inner sidewall at discrete locations spaced along a length of the frame member.

In other embodiments, the at least one panel clamping bed may extend at least partially along and inwards from the inner sidewall of each frame member, preferably entirely along the inner sidewall of each frame member. In such embodiments, the at least one panel clamping bed may include opposed ends that have the same end profile as the frame member from which it extends. For example, if the frame member has mitred ends, the at least one panel clamping bed may also have mitred ends.

As indicated above, the frame assembly includes a clamping clip configured to engage with the panel clamping bed for clamping the panel to the frame, preferably mechanically engage, more preferably adjustably engage to clamp panels of differing thicknesses. The clamping clip may be of any suitable size, shape and construction.

The clamping clip includes the retention portion configured to be at least partially received in the channel and the at least one clamping arm protruding away from the retention portion and configured to clamp against the clamping portion of the clamping bed and retain an edge portion of the panel therebetween when the retention portion is at least partially received in the channel.

The clamping clip may typically be elongate and of a same length as the panel clamping bed to which it is configured to engage or connect.

For example, in embodiments in which each frame member may include two or more panel clamping beds located at discrete locations spaced along a length of the frame member, the assembly may include two or more corresponding clamping clips each of substantially the same length as the respective panel clamping bed.

In other embodiments in which the panel clamping bed extends at least partially along a length of each frame member, the clamping clip may be provided of substantially the same length as the respective panel clamping bed. Like the at least one panel clamping bed, the clamping clip may include opposed ends that have the same end profile as the respective panel clamping bed and the frame member. For example, if the at least one panel clamping bed and the frame member have mitred ends, the clamping clip may also have mitred ends.

The retention portion of the clamping clip and the channel of the panel clamping bed may connect or engage together in any suitable way, preferably permanently such that once engaged the clip cannot be pulled away from the panel clamping bed. Preferably, the retention portion and the channel may connect or engage together in a one-way engagement arrangement.

For example, in some embodiments, the retention portion and the channel may be fastened together by one or more fasteners, such as, e.g., one or more chemical fasteners and/or one or more mechanical fasteners.

In some such embodiments, the retention portion and the channel may be fastened together by one or more chemical fasteners. The one or more chemical fasteners may include a wet adhesive, a dry adhesive and/or double-sided adhesive tape extending between engaging portions of the retention portion and the channel.

In other such embodiments, the retention portion and the channel may be fastened together by one or more mechanical fasteners. The one or more mechanical fasteners may include one or more threaded fasteners, rivets or spring-loaded fasteners.

In other embodiments, the retention portion and the channel may connect or engage together by a connecting mechanism or part of a connecting mechanism. The connecting mechanism may include a first part associated with the retention portion and a second part connectable to the first part and associated with the channel.

The part of the connecting mechanism may respectively include mateable male and female portions that couple together, including threaded connection or interference (snap fit) connections, for example.

A first part of the connecting mechanism associated with the retention portion may include a male formation configured to be inserted into or coupled with a female formation of a second part of the connecting mechanism associated with the channel. Conversely, the first part of the connecting mechanism may include a female formation configured to at least partially receive or couple with a male formation of the second part of the connecting mechanism.

In preferred embodiments, the retention portion may include a pair of legs interconnected by a web and extending substantially parallel to one another. In some such embodiments, the web may interconnect the legs at or near a common end. In other such embodiments, the web may interconnect the legs at a location about mid-way along the legs.

Typically, the legs may be configured to be frictionally fitted at least partially in the channel to engage or connect the clamping clip and the panel clamping bed together. In such embodiments, the web may function as a biasing member for biasing the legs apart from one another. The pressing of the retention portion into the channel may squeeze the legs at least partially towards each other against the biasing force of the web. In some such embodiments, a junction between the web and each leg may include a flexion point to at least partially assist in flexing of the legs at least partially towards each other against the biasing force of the web. When at least partially received in the channel, the web of the retention portion may urge or bias the legs away from one another into engagement with respective sidewalls of the channel ensuring a secure frictional fit is achieved between an outer surface of each leg and a respective sidewall.

As indicated, the retention portion and the channel may each include at least one key arrangement configured to intermesh with each other when the retention portion is at least partially pressed into the channel. The key arrangements may respectively extend from and along an outer surface of each leg and an inner surface of each sidewall of the channel. Preferably, the key arrangements may each be of integral/unitary construction with the panel clamping bed of each frame member and the clamping clip, respectively.

The key arrangements may intermesh with each other when the legs of the retention portion are pressed into the channel and prevent the clamping clip from being separated/pulled away from the panel clamping bed. As indicated, the key arrangements may intermesh with each other at a plurality of positions thereby enabling panels of differing thicknesses to be accommodated and clamped to the security frame.

Each key arrangement may include any suitable number of keys spaced along a length of the arrangement at any suitable spaced interval and the keys may be of any suitable size and shape provided they can engage with one another and retain the retention portion within the channel and form a secure joint. For example, each key may include, on one or both its ends, a smooth rounded, arcuate, filleted, tapered, chamfered or angular lead-in edge or surface. Preferably, the keys of the respective keys arrangements of the retention portion and the channel may be in the form of teeth that angle or point away from each other to at least partially prevent disengagement of the respective key arrangements and the retention portion and the channel from being pulled apart.

In some embodiments, the keys in each key arrangement may be provided at spaced intervals to enable precise adjustment of the clamping clip relative to the panel clamping bed, typically about 0.5 mm or 1.0 mm intervals, preferably 0.5 mm. For example, the respective key arrangements may enable adjustment of the clamping clip relative to the panel clamping bed at 0.5 mm or 1.0 mm intervals.

In some embodiments, the intermeshing of the respective key arrangements may be enhanced by the application of a chemical fastener at least partially along each key arrangement. The chemical fastener may include a wet adhesive, a dry adhesive and/or double-sided adhesive tape extending between the respective key arrangements.

In some embodiments, the at least one clamping arm may orthogonally extend from an outer end of one of the legs in a direction substantially parallel with the clamping portion of the panel clamping bed when the clamping clip is pressed into the channel. The clamping arm may extend any suitable distance to be able to clamp an edge portion of the panel against the clamping portion, preferably in a linear direction.

In other embodiments, the at least one clamping arm may extend from the retention portion at an acute angle to at least partially enhance the clamping effect of the clamping arm against the clamping portion when the clamping clip is pressed into the channel. Specifically, the at least one clamping arm may extend from an outer end of one of the legs at an acute angle relative to the one of the legs. The at least one clamping arm may extend at an acute angle of about 70°, about 71°, about 72°, about 73°, about 74°, about 75°, about 76°, about 77°, about 78°, about 79°, about 80°, about 81°, about 82°, about 83°, about 84°, about 84°, about 85°, about 86°, about 87°, about 88°, or even about 89° relative to the leg from which the clamping arm extends. Typically, the at least one clamping arm may extend at an acute angle relative to the leg from which the arm extends of from about 75° to about 89°, preferably from about 80° to about 89°.

Advantageously, in such embodiments, the acute angle of the at least one clamping arm may at least partially enhance the clamping effect and/or enable adjustment of the clamping clip relative to the panel clamping bed.

In some such embodiments, the clamping clip may further include a flexion point at a junction between the leg and the at least one clamping arm to at least partially assist in flexing of the arm relative to the retention portion when the clamping clip is pressed into the channel to clamp an edge portion of the at least one panel therebetween.

The acute angle of the at least one clamping arm relative to the retention portion together with the respective key arrangements may enable precise adjustments of the clamping clip relative to the panel clamping bed of between about 0.2 and about 0.3 mm intervals.

In some embodiments, clamping arm and/or the clamping portion may each include a grip to assist in gripping an edge portion of the panel. In some such embodiments, the grip may include a liner or coating on at least a portion of the clamping arm and/or the clamping portion. In other embodiments, the grip may include one or more pads extending at least partially across the clamping arm and/or the clamping portion. The grip may be formed from a resilient deformable material or materials, such as, e.g., rubber or soft plastic material or materials.

In other embodiments, the clamping arm and/or the clamping portion may each include a plurality of teeth or ridges configured to bite into an edge portion of the panel when clamped in place. The teeth or ridges may typically be angled towards the frame member to at least partially prevent the panel from being pulled away from the frame member clamped to the peripheral edge.

In some embodiments, the assembly may further include a screen mesh or shade cloth configured to be fastened to the frame when assembled, preferably via a spline.

In preferred embodiments, the clamping clip may further include a spline channel for at least partially receiving the spline and securing the screen mesh or shade cloth to the frame when assembled. The spline channel may preferably be formed by the web interconnecting the pair of legs of the retention portion. In such embodiments, the web may have a concave curvature suitably sized and shaped to at least partially receive a spline.

In some such embodiments, the inner surfaces of the sidewalls of the spline channel may each include one or more teeth or ridges for biting into a spline received in the spline channel and retaining the spline in place.

In some embodiments, the assembly may further include a cover for covering the clamping clip/the panel clamping bed clamping arrangement. Typically, the cover may extend at least partially over the clamping clip and clamping bed. The cover may typically be of metal or plastic construction, preferably metal, more preferably aluminium. The cover may be fastened to an inner wall of each frame member by one or more mechanical or chemical fasteners as described above.

According to a seventh aspect of the present invention, there is provided a method of assembling a security frame for accommodating a decorative panel, said method including:

joining at least two frame members together to form the frame, each of the frame members including at least one panel clamping bed extending inwards from and at least partially along a length of an inner sidewall of the frame member and having a clamping portion and a channel, said channel being defined between the inner sidewall and the clamping portion;

aligning the panel relative to the frame and inserting the panel such that each peripheral edge portion of the panel rests at least partially against a respective said clamping portion of the at least one panel clamping bed; and clamping each peripheral edge of the panel in place by aligning and pressing a clamping clip having a retention portion and at least one clamping arm extending from the retention portion against the at least one panel clamping bed such that the clamping arm clamps the peripheral edge of the panel against the clamping portion and the retention portion is at least partially received in the channel, wherein said channel and said retention portion each include at least one key arrangement configured to intermesh with each other at a plurality of positions when the retention portion is at least partially received in the channel thereby enabling decorative panels of differing thicknesses to be accommodated and clamped to the frame.

The method may include one or more characteristics or features of the decorative panel, assembly, frame, frame member or clip as hereinbefore described.

For example, the clamping may include pressing the clamping clip into the at least one panel clamping bed until the clamping arm is firmly clamping the peripheral edge of the decorative panel against the clamping portion.

In some embodiments, the method may include a further step of aligning and fastening a screen mesh or shade cloth atop the panel. The screen mesh or shade cloth may be fastened with a spline configured to be received in a spline channel provided on an outer side of the clamping clip when engaged with the at least one panel clamping bed.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of Invention in any way. The Detailed Description will make reference to a number of drawings as follows:

FIGS. 11A to 110 are line drawings respectively showing cross sectional views of part of an assembled security frame according to an embodiment of the present invention accommodating decorative panels of differing thicknesses.

DETAILED DESCRIPTION

Figure 2:
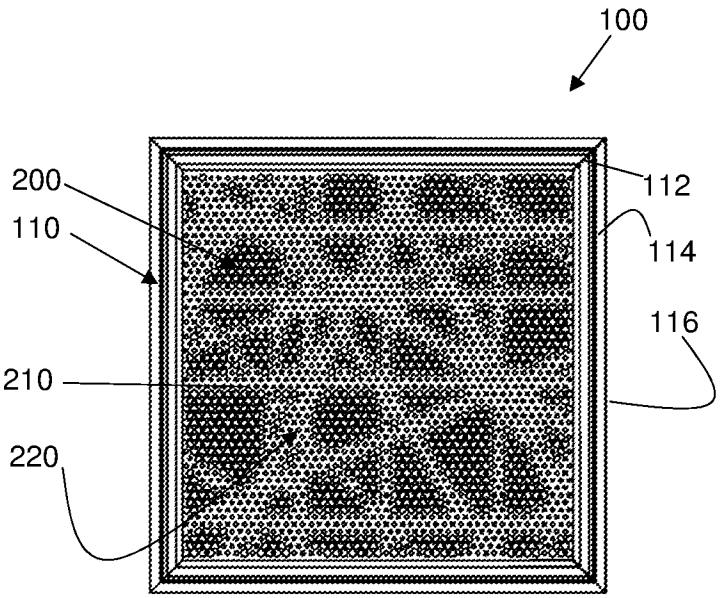
FIG. 2 is a line drawing showing a rear view of a security window frame with a fitted decorative panel according to an embodiment of the present invention for fitting to a window opening.
Figure 1:
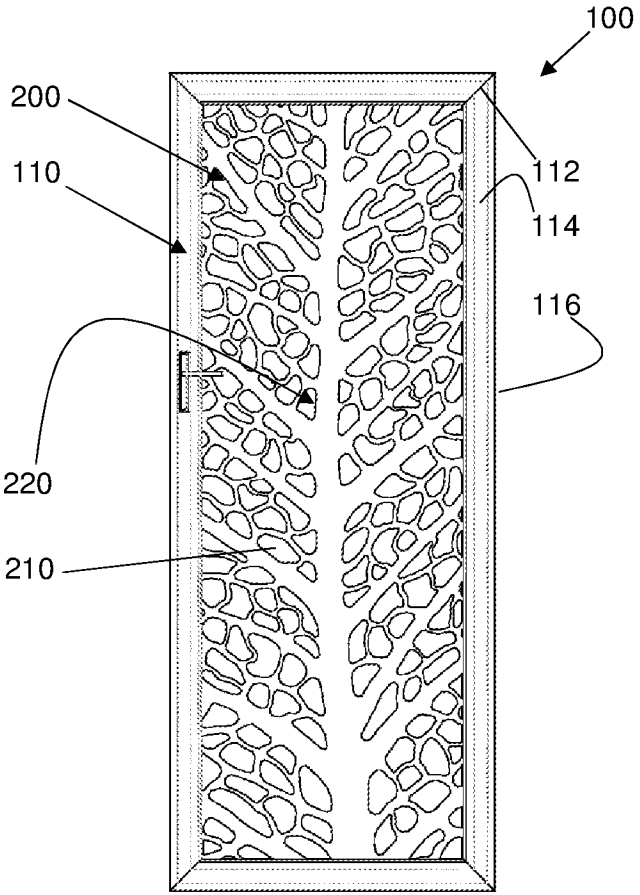
FIG. 1 is a line drawing showing a front view of a security door frame with a fitted decorative panel according to an embodiment of the present invention for fitting to a door opening.

FIGS. 1 to 11 show embodiments of a security frame (100) and parts thereof according to the present invention.

Referring to FIGS. 1 to 4, the security frame (100) is formed from four frame members (110) connected together in an end-to-end manner to form the frame (100) for accommodating a decorative panel (200). Each frame member (110) includes a pair of opposed open ends (112), an outer wall (114), an opposed inner wall (116) and a pair of opposed sidewalls, including an inner sidewall (117; not visible) and an opposed outer sidewall (118; not visible).

The frame (100) further includes a panel clamping bed (300; not visible) and a clamping clip (400; not visible), which together clamp the panel (200) to the frame (100). These will be described in detail later.

As shown, the decorative panel (200) has a substantially rectangular shape for filling a central void of the frame (100) and filling a door or window opening.

Each panel (200) has two opposed surfaces extending substantially parallel to one another and interconnected by opposing edges. The panel (200) further includes a plurality of perforated openings (210) extending through both surfaces and arranged on the panel to create a decorative motif (220). The openings (210) are generally formed by one or more of laser cutting, router cutting, water jet cutting, jig saw cutting, plasma cutting, punching and/or any other process capable of forming a defined opening (210).

The panel (200), frame (100) and frame members (110) are all formed of aluminium.

The panel (200) has a thickness, extending between the opposed surfaces, which may range from about 0.2 mm to about 10 mm. Typically, the thickness of the panel (200) can vary according to security demands and the particular motif (220) to be arranged on the panel (200).

The frame members (110) forming the security frame (100) each have an elongate shape extending longitudinally in a linear direction between the opposed open ends (112). Each frame member (110) is an extrusion having a substantially rectangular shape.

Figure 4:
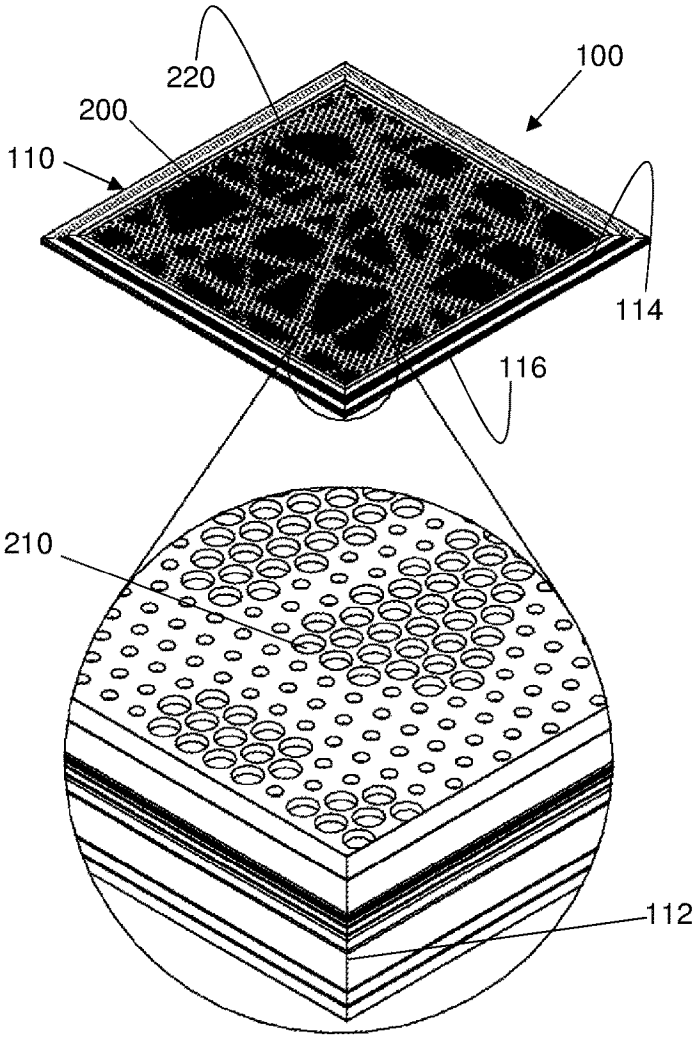
FIG. 4 is a line drawing showing perspective and magnified views of the frame as shown in FIG. 2.
Figure 3:
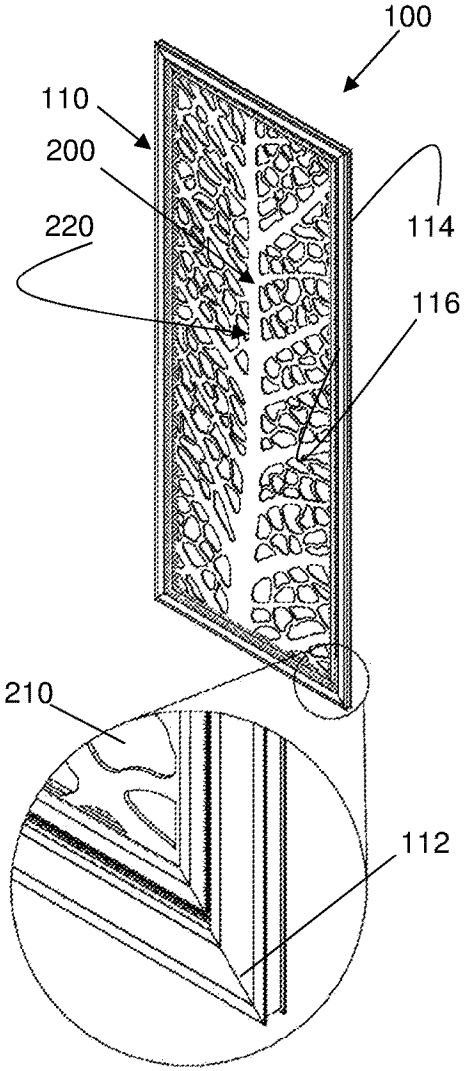
FIG. 3 is a line drawing showing perspective and magnified views of the frame as shown in FIG. 1.

Best shown in FIGS. 3 and 4, the frame members (110) are joined together in an end-to-end manner at right angles to form a rectangular-shaped frame (100). Each frame member (110) has "profiled" ends (112) such that the ends (112) of adjacent frame members (110) can meet flush.

Figure 5:
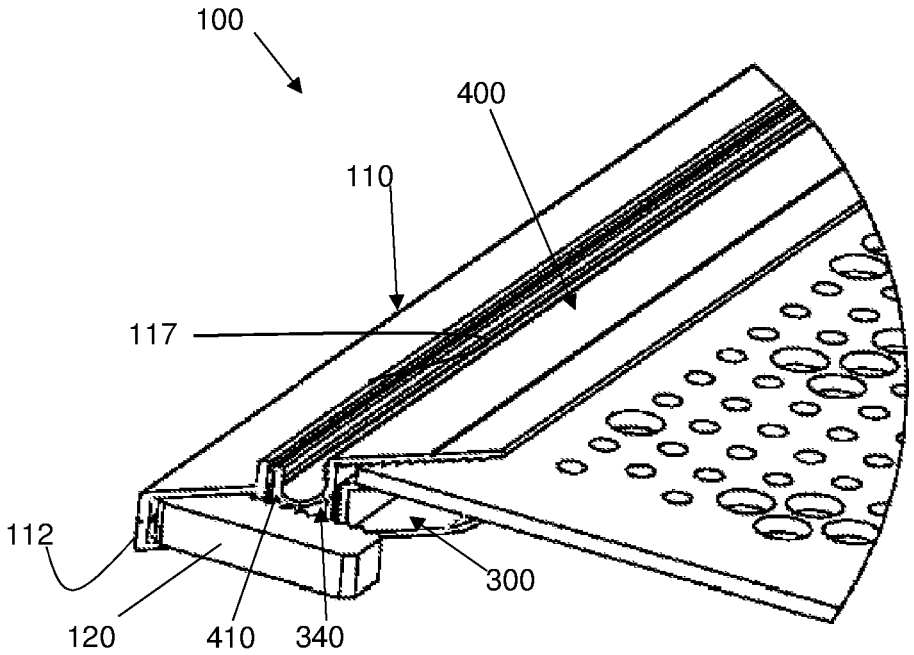
FIG. 5 is a line drawing showing a perspective view of a corner of a partially assembled security frame with a fitted decorative panel according to an embodiment of the present invention.
Figure 6:
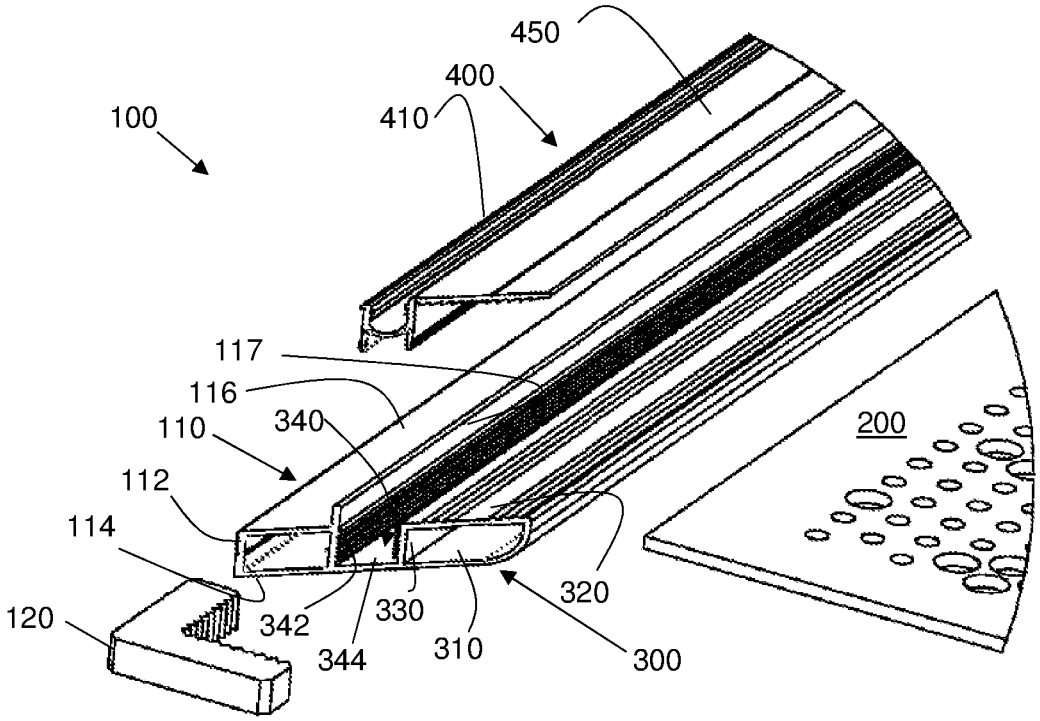
FIG. 6 is an exploded view of the partially assembled security frame as shown in FIG. 5.

Referring to FIGS. 5 and 6, adjacent frame members (110) are joined together via a joining component in the form of a corner connector (120). Each corner connector (120) is substantially L-shaped and configured to be partially fitted in the open and "profiled" ends (112) of the frame members (110) to be joined. The corner connector (120) is formed from plastic or metal material or materials, typically fibreglass.

As indicated above, the frame (100) includes the panel clamping bed (300), which extends inwardly from and entirely along an inner sidewall (117) of each frame member (110). The clamping bed (300) is integrally formed with each frame member (110).

Referring to FIG. 6, the clamping bed (300) has a substantially rectangular profile shape. The clamping bed (300) is formed by three portions of the outer wall (114) extending inwards and past the inner sidewall (117), including: a first portion (310) extending inwards in a direction away from the inner sidewall (117) and at least partially curving towards the inner wall (116) of the frame member (110); a second portion or clamping portion (320) extending from the first portion (310) at least partially towards the inner sidewall (117) in a linear direction co-planar with the inner and outer walls (114, 116) of the frame member (110); and a third portion (330) orthogonally extending in a linear direction from the clamping portion (320) to the first portion (310) to additionally define a channel (340) between the inner sidewall (117) and the third portion (330).

The channel (340) is defined by a pair of opposed sidewalls (342) corresponding to at least a part of the inner sidewall (117) of the frame member (110) and at least a part of the third portion (330) of the panel clamping bed (300), and a bottom wall (344) corresponding to at least a part of the first portion (310) of the panel clamping bed (300). The channel (340) is sized and shaped to snugly receive and frictionally engage part of the clamping clip (400).

The panel clamping bed (300), like the ends (112) of the frame members (110), has "profiled" ends.

As indicated above, the clamping clip (400) is configured to engage with the panel clamping bed (300) and adjustably clamp the panel (200) to the frame (100). Advantageously, the clip (400) adjustably clamps the panel (200) to the panel clamping bed (300) enabling panels (200) ranging in thickness from about 0.2 mm to about 10 mm to be clamped to the frame (100). This will be described in detail later.

The clamping clip (400) is formed of aluminium and is an extrusion.

The clamping clip (400) includes a retention portion (410) configured to be at least partially received in the channel (340) and a clamping arm (450) extending away from the retention portion (410) and configured to clamp against the clamping portion (320) of the clamping bed (300) and retain an edge portion of a panel (200) therebetween when the retention portion (410) is at least partially received in the channel (340).

The clamping clip (400) is elongate and of a same length as the panel clamping bed (300) to which it is configured to engage or connect.

Like the panel clamping bed (300) and the frame member (110), the clamping clip (400) has "profiled" ends.

Referring again to FIG. 5, the clamping clip (400) and the panel clamping bed (300) are permanently connected together by an interference fit in which the retention portion (410) of the clip (400) is frictionally fitted into the channel (340) of the clamping bed (300). Once connected, the clip (400) cannot be pulled away from the clamping bed (300).

Figure 7:
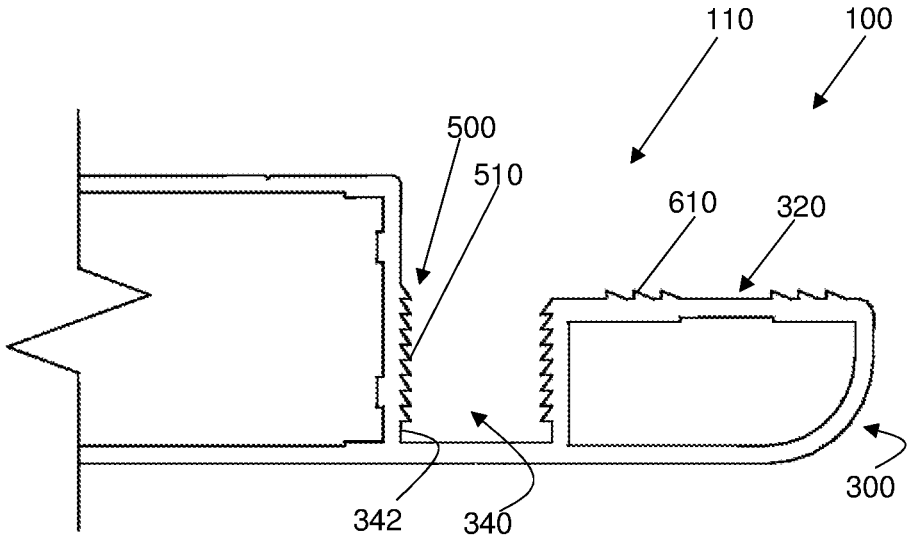
FIG. 7 is a line drawing showing an end view of part of a frame member, including the panel clamping bed, of a security frame similar to the frame as shown in FIGS. 5 and 6.
Figure 8:
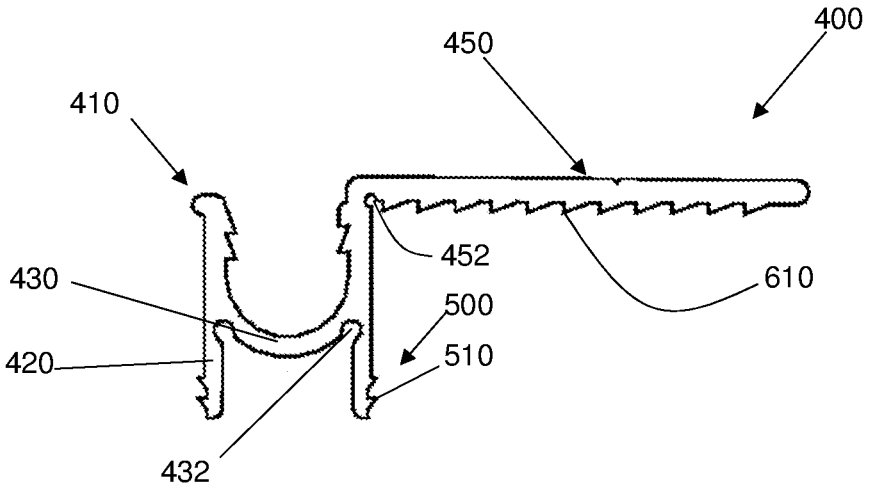
FIG. 8 is a line drawing showing an end view of a clamping clip of the security frame as shown in FIGS. 5 and 6.

Referring to FIG. 8, the retention portion (410) of the clip (400) includes a pair of legs (420) interconnected by a web (430). The legs (420) extend substantially parallel to one another and the web (430) interconnects the legs (420) at a location about mid-way along the legs (420). A junction between the web (430) and each leg (420) includes a flexion point (432) to assist the legs (420) in flexing towards each other relative to the web (430), when the retention portion (410) is frictionally fitted into the channel (340; shown in FIG. 7).

The web (430) functions as a biasing member for biasing the legs (420) apart from one another. In use, the pressing of the retention portion (410) into the channel (340; shown in FIG. 7) squeezes the legs (420) about the flexion point (432) partially towards each other against the biasing force of the web (430). When received in the channel (340; shown in FIG. 7), the web (430) urges or biases the legs (420) away from one another into engagement with the respective sidewalls (342; shown in FIG. 7) of the channel (340; shown in FIG. 7) ensuring a secure frictional fit is achieved.

The clamping arm (450) extends in a linear direction from an outer end of one of the legs (420) at an acute angle of from about 80° to about 89° relative to the leg (420) from which the arm (450) extends. Advantageously, the acute angle at least partially enhances the clamping effect. The clamping arm (450) extends any suitable distance to be able to clamp an edge portion of the panel (200; not shown) against the clamping portion (320; shown in FIG. 7).

The clamping clip (400) further includes at a junction between the leg (420) and the clamping arm (450) a flexion point (452) to at least partially assist in flexing of the arm (450) relative to the retention portion (410) when the clamping clip (400) is pressed into the channel (340; shown in FIG. 7) to securely clamp a panel (200; not shown) in place.

Referring to both FIGS. 7 and 8, the retention portion (410) and the channel (340) each further include respective teeth arrangements (500; i.e., key arrangements) configured to interlock or intermesh with each other when the retention portion (410) is at least partially pressed into the channel (340).

The respective teeth arrangements (500) extend partially along an outer surface of each leg (420) and partially along an inner surface of each sidewall (342) of the channel (340). The teeth arrangements (500) are each of integral construction with the retention portion (410) and the channel (340).

The respective teeth arrangements (500) interlock with one another when the legs (420) of the retention portion (410) are pressed into the channel (340) and prevent the clamping clip (400) from being separated/pulled away from the panel clamping bed (300). The teeth arrangements (500) are capable of interlocking with one another at a plurality of positions thereby enabling panels (200; not shown) of differing thicknesses to be accommodated and clamped to the security frame (100).

Each teeth arrangement (500) includes a number of teeth (510) spaced along a length of the arrangement (500) at intervals of 0.5 mm. Each tooth (510) is angled or pointed away from the other corresponding respective arrangement (500) to prevent disengagement of the respective key arrangements (500) and the retention portion (410) and the channel (340) from being pulled apart.

The spaced intervals of 0.5 mm between adjacent teeth (510) of each arrangement (500) enable precise adjustment of the clamping clip (400) relative to the panel clamping bed (300) at 0.5 mm intervals. Together with the acute angle of the clamping arm (450) relative to the retention portion (410), precise adjustments of the clamping clip (400) relative to the panel clamping bed (300) of 0.2-0.3 mm intervals are envisaged.

The clamping arm (450) and the clamping portion (320) each include a plurality of teeth (610) configured to bite into an edge portion of the panel (200; not shown) when clamped in place. The teeth (610) are also angled towards the frame member (110; only shown in FIG. 7) to prevent the panel (200; not shown) from being pulled away from the frame member (110; only shown in FIG. 7) clamped to the peripheral edge. Advantageously, the acute angle of the clamping arm (450) relative to the retention portion (410) enhances the clamping effect and thus assists the teeth (610) in biting into an edge portion of the panel (200; not shown) when clamped in place.

Figure 9:
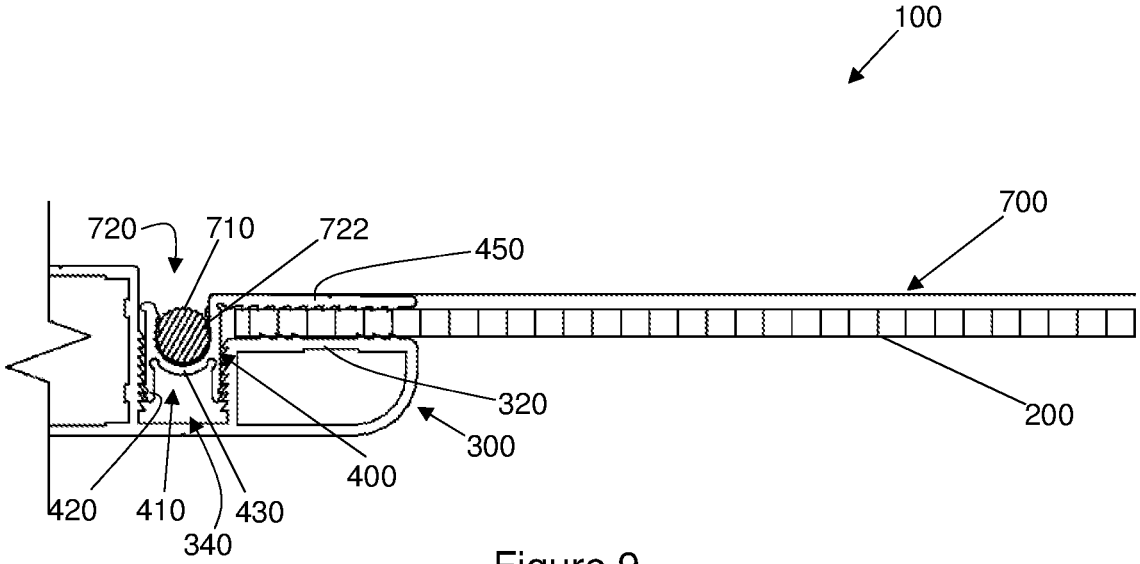
FIG. 9 is a line drawing showing a cross sectional view of part of the partially assembled security frame as shown in FIGS. 5 and 6 with a fitted screen mesh.
Figure 10:
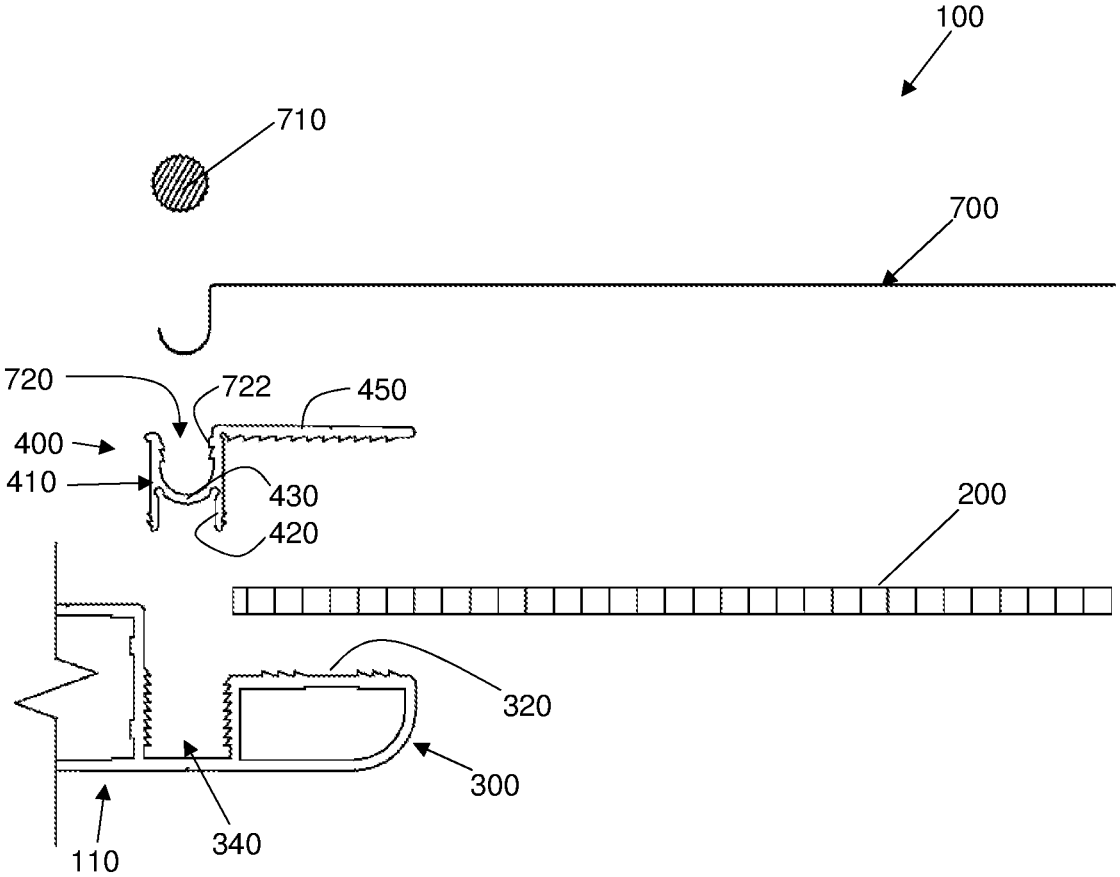
FIG. 10 is an exploded view of the part of the partially assembled security frame as shown in FIG. 9.

Referring to FIGS. 9 and 10, in some embodiments, the frame (100) further includes a screen mesh (700) configured to be fastened to the frame (100) when assembled via a spline (710).

In such embodiments, the clamping clip (400) further includes a spline channel (720) for receiving the spline (710) and securing the screen mesh (700) to the frame (100) when assembled. The spline channel (720) is formed by the web (430) interconnecting the pair of legs (420) of the retention portion (410). As shown, the web (430) has a concave curvature at least partially complementing the substantially circular profile shape of the spline (710).

As also shown, the inner surfaces of the sidewalls of the spline channel (720) each include teeth (722) for biting into the spline (710) and retaining the spline (710) when received in the spline channel (720) as shown in FIG. 9.

Figure 11A:
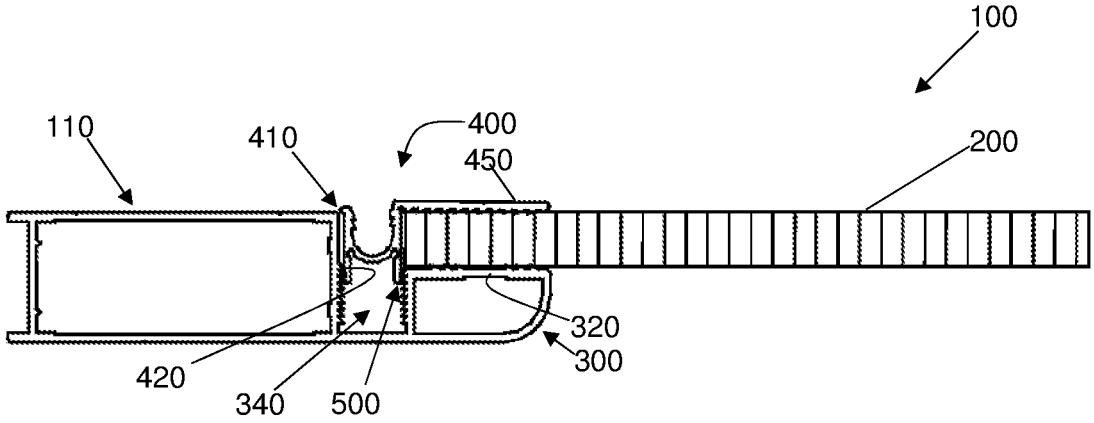

Referring to FIG. 11A to 110, these figures respectively show the clamping clip (400) and the panel clamping bed (300) connecting to one another to clamp panels (200) of differing thicknesses.

FIG. 11A shows a frame member (110) clamped to an 8 mm thick panel (200). To clamp the panel (200), the retention portion (410) of the clamping clip (400) is pressed into the channel (340) until the clamping arm (450) firmly clamps an edge portion of the panel (200) against the clamping portion (320) of the clamping bed (300).

As shown, the respective teeth arrangements (500) together with the frictionally fitted legs (420) of the retention portion (410) ensure the clamping clip (400) is permanently connected to the clamping bed (300). Put another way, the clamping clip (400) is unable to be disengaged from the clamping bed (300) due to the frictionally fitted legs (420) and the interlocking of the respective teeth arrangements (500).

Figure 11B:
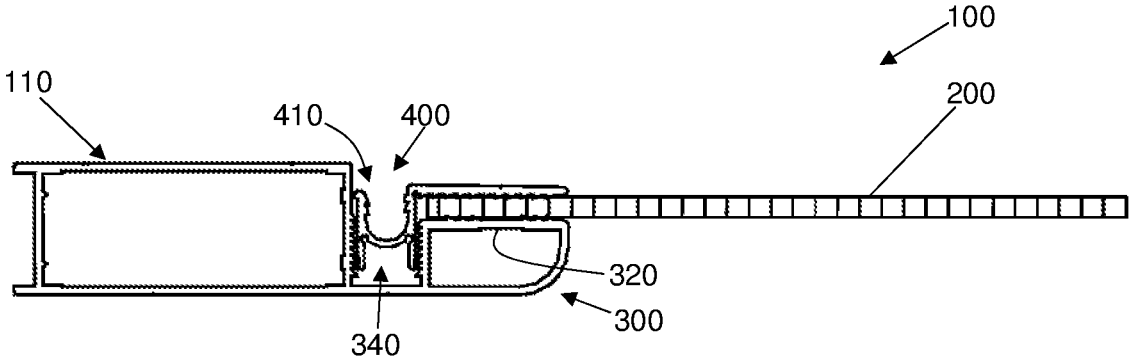

FIG. 11B shows a frame member (110) clamped to a 3 mm thick panel (200). In this figure, the retention portion (410) of the clamping clip (400) is shown pressed further into the channel (340) so as to firmly clamp the thinner panel (200) against the clamping portion (320) than as shown in FIG. 11A.

Figure 11C:
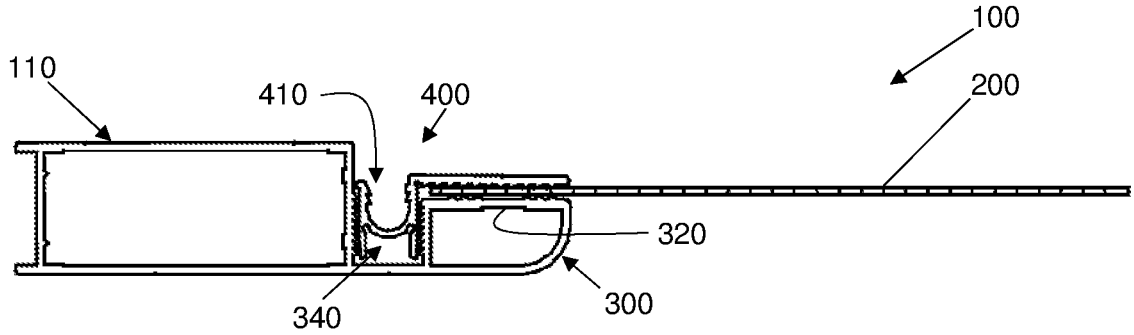

FIG. 11C shows a frame member (110) clamped to a 1 mm thick panel (200). As shown, in this figure the retention portion (410) of the clamping clip (400) is shown pressed the furthest into the channel (340) when compared to FIGS. 11A and 11B.

A method of assembling the frame (100) will now be described in detail with reference to FIGS. 5, 6, 9 and 10.

With reference to FIGS. 5 and 6, a first step includes joining frame members (110) together in an end-to-end manner. An L-shaped corner connector (120) is partially fitted in the open and "profiled" ends (112) of the frame members (110) to be joined.

With reference to FIG. 10, the next step includes aligning the panel (200) relative to the assembled frame (100) and inserting the panel (200) so that a peripheral edge portion of the panel (200) rests against a clamping portion (320) of the panel clamping bed (300) extending along an inner side of each frame member (110).

Each peripheral edge portion of the panel (200) is then clamped in place by aligning and pressing a clamping clip (400) against the panel clamping bed (300) such that the retention portion (410) is frictionally fitted into the channel (340) and the clamping arm (450) firmly clamps the panel (200) against the clamping portion (320) as shown in FIG. 9.

Referring again to FIG. 10, a screen mesh (700) can be optionally fitted. The screen mesh (700) is aligned and fastened to the frame (100) atop the panel (200). The mesh (700) is fastened with a spline (710) pressed against an outer surface of the mesh (700) to clamp the mesh (700) against the frame (100). The spline (710) is pressed into a spline channel (720) provided on an outer side of the retention portion (410) of the clamping clip (400) to clamp the mesh (700) in place as again shown in FIG. 9.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A security frame assembly for accommodating at least one decorative panel comprising:

at least two frame members connectable together to form a frame for accommodating the at least one decorative panel, each of the frame members comprises a pair of opposed ends, an outer wall, an opposed inner wall and a pair of opposed side walls, including an inner sidewall and an opposed outer sidewall;

at least one panel clamping bed extending inwards from and at least partially along a length of the inner sidewall of each frame member and having a clamping portion and a channel, said channel being defined between the inner sidewall and the clamping portion; and at least one clamping clip comprising a retention portion, at least one clamping arm extending from the retention portion and configured to clamp a peripheral edge portion of the at least one decorative panel against the clamping portion when the retention portion is at least partially received in the channel and a spline channel for at least partially receiving a spline for securing a screen mesh or shade cloth to the frame, said retention portion and said spline channel comprising a pair of legs extending substantially parallel to one another and a web interconnecting the pair of legs to define the retention portion on a first side and the spline channel on an opposed second side of the at least one clamping clip, wherein said pair of legs of the retention portion are configured to be frictionally fitted in the channel when the retention portion is at least partially received in the channel and said web functions as a biasing member for biasing the pair of legs apart from one another into engagement with sidewalls of the channel, wherein said retention portion comprises a flexion point provided at a junction between each of said pair of legs and the web so as to enable flexion of the legs at least partially towards each other against a biasing force of the web when being frictionally fitted into the channel and so as to resist flexion of the pair of legs towards each other when a spline is received in the spline channel, and wherein said channel and said retention portion each comprise at least one key arrangement configured to intermesh with each other at a plurality of positions when the retention portion is at least partially received in the channel thereby enabling decorative panels of differing thicknesses to be accommodated and clamped to the security frame.

2. The security frame assembly of claim 1, wherein the security frame assembly is configured to be fitted to a door or window.

3. The security frame assembly of claim 1, wherein the at least one decorative panel comprises a plurality of perforated openings arranged on the at least one decorative panel to create a decorative pattern, motif, shape or word.

4. The security frame assembly of claim 1, wherein the retention portion of the at least one clamping clip and the channel of the at least one panel clamping bed permanently connect together in a one-way engagement arrangement when the retention portion is at least partially received in the channel.

5. The security frame assembly of claim 1, further comprising a screen mesh or shade cloth configured to be secured to the frame when assembled by a spline at least partially received in the spline channel.

6. The security frame assembly of claim 1, wherein the at least one clamping clip when engaged with the at least one panel clamping bed is adjustable to accommodate decorative panels of differing thicknesses.

7. The security frame assembly of claim 6, wherein the assembly is adapted to accommodate and clamp decorative panels ranging in thickness from about 0.2 mm to about 10 mm.

8. The security frame assembly of claim 1, wherein the key arrangements enable adjustment of the at least one clamping clip relative to the at least one panel clamping bed in about 0.5 mm intervals.

9. The security frame assembly of claim 8, wherein each key in the key arrangements are provided at spaced intervals of about 0.5 mm.

10. The security frame assembly of claim 8, wherein the retention portion comprises two key arrangements and the channel comprises two key arrangements and wherein the two key arrangements of the retention portion are configured to intermesh with the two key arrangements of the channel when the retention portion is at least partially received in the channel.

11. The security frame assembly of claim 10, wherein the two key arrangements of the retention portion respectively extend from and along an outer surface of each of the pair of legs.

12. The security frame assembly of claim 10, wherein the two key arrangement of the channel respectively extend from and along an inner surface of each channel sidewall.

13. The security frame assembly of claim 1, wherein the respective said at least one key arrangements of the retention portion and the channel angle or point away from each other to prevent disengagement of the key arrangements when intermeshed and when the retention portion is at least partially received in the channel.

14. The security frame assembly of claim 13, wherein keys of each of the at least one key arrangements comprise teeth having an angular lead-in edge that angles away from a direction of engagement.

15. A method of assembling a security frame for accommodating at least one decorative panel comprising:

joining at least two frame members together to form the frame, each of the frame members comprising at least one panel clamping bed extending inwards from and at least partially along a length of an inner sidewall of the frame member and having a clamping portion and a channel, said channel being defined between the inner sidewall and the clamping portion;

aligning the at least one decorative panel relative to the frame and inserting the at least one decorative panel such that each peripheral edge portion of the at least one decorative panel rests at least partially against a respective said clamping portion of the at least one panel clamping bed; and clamping each peripheral edge of the at least one decorative panel in place by aligning and pressing a clamping clip having a retention portion and at least one clamping arm extending from the retention portion against the at least one panel clamping bed such that the clamping arm clamps the peripheral edge of the at least one decorative panel against the clamping portion and the retention portion is at least partially received in the channel; and securing a screen mesh or shade cloth to the frame by aligning and pressing a spline into a spline channel defined on the clamping clip, wherein said retention portion and said spline channel comprise a pair of legs extending substantially parallel to one another and a web interconnecting the pair of legs to define the retention portion on a first side and the spline channel on an opposed second side of the clamping clip, wherein said pair of legs of the retention portion are configured to be frictionally fitted in the channel when the retention portion is at least partially received in the channel and said web functions as a biasing member for biasing the pair of legs apart from one another into engagement with sidewalls of the channel, wherein said retention portion comprises a flexion point provided at a junction between each of said pair of legs and the web so as to enable flexion of the legs at least partially towards each other against a biasing force of the web when being frictionally fitted into the channel and so as to resist flexion of the pair of legs towards each other when a spline is pressed into the spline channel, and wherein said channel and said retention portion each comprise at least one key arrangement configured to intermesh with each other at a plurality of positions when the retention portion is at least partially received in the channel thereby enabling decorative panels of differing thicknesses to be accommodated and clamped to the frame.

16. The method of claim 15, wherein said clamping comprises pressing the at least one clamping clip into the at least one panel clamping bed until the clamping arm is firmly clamping a peripheral edge of the at least one decorative panel against the clamping portion.

* * * * *